US005600854A

United States Patent [19]

Henrekin

[11] Patent Number: 5,600,854

[45] Date of Patent: Feb. 11, 1997

[54] ADJUSTABLE STRAP FASTENER ASSEMBLY FOR BODY-ENCIRCLING HAT BAND, COLLAR OR BELT

[76] Inventor: Susan Henrekin, 2921 Kellogg St., San Diego, Calif. 92106

[21] Appl. No.: 373,743

[22] Filed: Jan. 17, 1995

[51] Int. Cl.[6] ..... A42B 1/22

[52] U.S. Cl. ..... 2/195.2; 2/183; 2/311; 24/197

[58] Field of Search ..... 2/171, 181, 183, 2/195.2, 195.3, 195.4, 311, 312, 338, 417, 418, 420, DIG. 11; 24/170, 197, 306

[56] References Cited

U.S. PATENT DOCUMENTS

| | | | |
|---|---|---|---|
| 1,127,598 | 2/1915 | Cunningham | 2/311 |
| 1,652,145 | 12/1927 | Lipschutz | 2/195.3 |
| 1,697,833 | 1/1929 | Lane | 24/170 |
| 1,781,078 | 11/1930 | Place | 24/197 |
| 3,396,408 | 8/1968 | Enger | 2/183 |
| 3,500,474 | 3/1970 | Austin | 2/3 |
| 3,513,481 | 5/1970 | Nickerson | 2/3 |
| 4,011,600 | 3/1977 | Malk | 2/183 |
| 4,845,782 | 7/1989 | Gregg | 2/172 |
| 4,878,274 | 11/1989 | Patricy | 24/306 |
| 5,046,488 | 9/1991 | Schiek, Sr. | 128/78 |
| 5,142,705 | 9/1992 | Edwards | 2/418 |

FOREIGN PATENT DOCUMENTS

| | | | |
|---|---|---|---|
| 940827 | 9/1928 | Australia | 24/197 |
| 1331444 | 5/1962 | France | 2/195.2 |
| 2487647 | 2/1982 | France | 24/197 |
| 166334 | 7/1950 | Germany | 247/197 |

*Primary Examiner*—Diana Biefeld

*Attorney, Agent, or Firm*—Brown, Martin, Haller & McClain

[57] ABSTRACT

An adjustable fastener assembly for forming an adjustable loop around a portion of a wearer's body has an body has an elongate member for encircling the body portion and first and second interengageabie end portions at opposite ends of the elongate member. One of the end portions is a buckle and the other is a strap for releasable threaded engagement through the buckle with the free end of the strap on the inside of the loop. Secondary fasteners such as mateable strips of Velcro® material are provided on the opposing inner faces of the free strap end and inner face of the loop. The elongate member may be a belt or waistband, a collar for an animal, or a hat band or sweat band of a cap or hat.

17 Claims, 1 Drawing Sheet

ADJUSTABLE STRAP FASTENER ASSEMBLY FOR BODY-ENCIRCLING HAT BAND, COLLAR OR BELT

BACKGROUND OF THE INVENTION

The present invention relates generally to adjustable fasteners for tightening body-encircling members around an appropriate portion of a wearer's body, such as adjustable hat bands, belts, animal collars and the like.

Belts, animal collars and similar straps for encircling a wearer's waist or an animal's neck typically have a buckle at one end through which the other strap end is threaded and adjustably secured. The free end of the strap typically lies loosely on the outside of the loop formed by the fastened belt. Various types of buckles are known, and most consist of one or more rings of metal or the like, through which the free strap end is drawn, tightened, and then secured. Similar fastening devices are used for adjusting the fit of a hat by selectively reducing or increasing the diameter of a hat band extending around the internal periphery of the hat. The loose or free strap end can be a problem and may allow the strap to slip back and loosen the band.

SUMMARY OF THE INVENTION

It is an object of the present invention to provide a new and improved adjustable fastener assembly for securing in a loop around a portion of a wearer's body.

According to the present invention, an elongate member is provided for encircling a portion of a wearer's body, the elongate member having an inner face facing the body, an outer face, and interengageable end portions for adjustable interengagement to form the elongate member into a loop for releasably fitting around the body portion, one of the interengageable end portions comprising a buckle and the other interenqageable end portion comprising a strap for releasable threaded engagement through the buckle with a free end portion of the strap on the inside of the loop, the inner face of the elongate member and the inner face of the strap each having an interengageable fastener device for releasable engagement with the fastener device on the opposing inner face to form a secondary connection to secure the elongate member in a loop.

In a preferred embodiment of the invention, the interengageable fastener devices comprise opposing strips of hook and loop type fastener material, such as Velcro®. The strap is threaded through the buckle and doubled back on the inside of the loop so that the strips of hook and loop fastener material face each other, and is then pressed against the opposing strip on the inner face of the loop. By providing the connection on the inner face of the loop, pressure of the wearer's body or hoop tension against the inner flap or end of the strap will tend to hold the opposing fastener devices in place and prevent slipping. This also avoids the problem of having a loose strap end hanging freely on the outside of a loop.

The elongate member may comprise a hat band or sweat band extending around the lower peripheral edge of a hat, for example, while the interengageable buckle and strap allow the periphery of the hat to be adjusted to fit the wearer's head. Alternatively, it may comprise a collar for fitting around an animal's neck, or a belt for fitting around a wearer's waist.

The buckle may be of any type but in the preferred embodiment a buckle comprising a pair of overlapping rings is provided. The strap end threads in one direction through the center of the innermost one of the rings, then around the outside of the second or outer ring and doubles back in the opposite direction through the center of the outer ring and back through the inner ring to the inside of the resultant loop. Preferably, the rings are of non-rigid, flexible but non-extensible material such as fabric, rope, nylon line, and other equivalent materials. This avoids the use of metal and thus reduces the risk of injury to the wearer in the case of impact, and will be more comfortable for the wearer.

This arrangement provides an adjustable fastener for a hat, belt, collar or the like which is capable of securely holding a hat, belt or collar in any one of a large number of adjusted positions, and provides both a desirable appearance and comfort in use. The combination of a buckle with a secondary fastener on the inside of the loop provides the required strength to prevent slipping and loosening after the fastener is secured. In fact, the position of the secondary fastener ensures that any loop tension would actually tend to hold the secondary fastener more firmly in place, rather than loosening it.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENT

Figure 1:
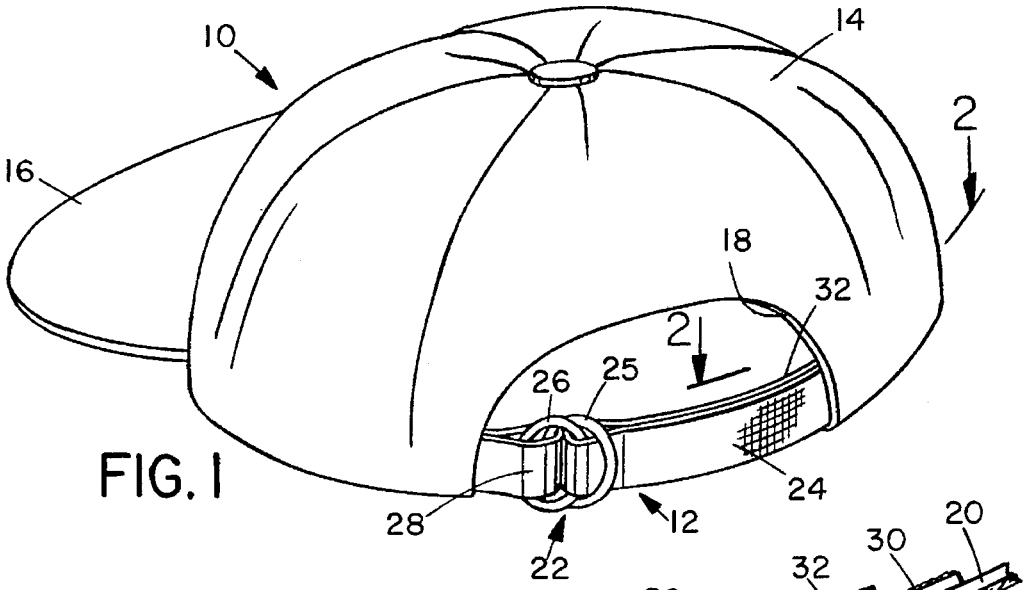
FIG. 1 is a perspective view of a typical cap incorporating an adjustable fastener assembly according to one embodiment of the invention.

FIG. 1 of the drawings illustrates a hat or cap 10 having an adjustable fastener assembly 12 for adjusting the periphery of the cap to fit around a wearer's head. Although the hat illustrated is of the baseball cap type, it will be understood that the same adjustable fastener assembly may be used on other styles of hat in an equivalent manner. The cap 10 includes a head-covering crown portion 14, a front visor 16, and an adjustment opening 18 at the rear. A sweat band 20 or the like extends around the internal periphery of the cap adjacent its lower edge, and the adjustable fastener assembly 12 comprises interengageable end portions projecting from opposite sides of the opening 18, one of the end portions comprising a buckle 22 and the other end portion comprising a strap 24 for threaded engagement through the buckle.

Figure 2:
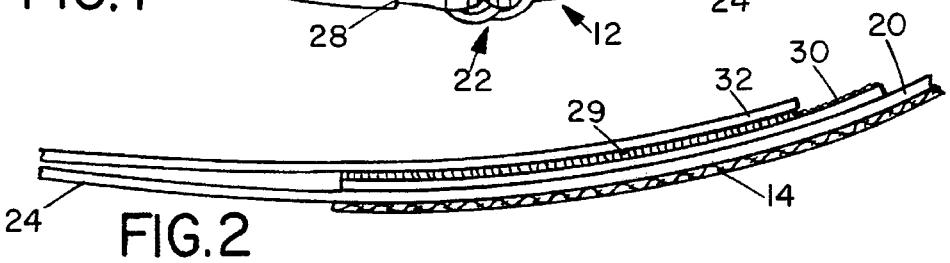
FIG. 2 is an enlarged sectional view taken on line 2—2 of FIG. 1.

The buckle comprises a pair of overlapping inner and outer rings 25, 26 which are each secured to a strap loop 28 which is attached by stitching or the like to one side of opening 18. The rings 25, 26 are preferably of a non-rigid, non-extensible material such as fabric, rope or the like. Strap 24 is secured at one end to the opposite side of opening 18, or may comprise an extension of hat band 20. The free end of strap 24 can then be threaded through the overlapping rings and doubled back to the desired extent so that the resultant loop is a close fit over the wearer's head. The strap is threaded through the rings so that the free end of the strap is on the inside of the resultant loop, rather than on the outside as is conventional in buckle fasteners. A secondary fastener is provided between the free end of the strap and the inside of the loop by means of mateable strips 29,30 of hook and loop type fastener material on the inside of hat band 20 adjacent the opening 18 and on the inner face of the strap 24 adjacent its free end 32, as best illustrated in FIG. 2. The hook and loop type fastener material is preferably Velcro®. Other types of interengageable fastener devices may be provided, such as snap fasteners or the like, although Velcro® is preferred since it will be more comfortable for the wearer and will provide a larger degree of adjustability and make it easier to adjust the amount of overlap between the two strips.

The manner in which the strap 24 is threaded through the overlapping rings and doubled back on the inside of the resultant loop or ring is best illustrated in FIG. 1. The strap is first threaded through the center of the first or inner ring 25, then around the outside of outer ring 26 before doubling back through the centers of both ring 26 and ring 25 to be located on the inside of the resultant loop. The strap is pulled through the buckle before tightening to a sufficient extent to achieve the desired loop diameter. The buckle rings are then tightened to grip the doubled over portion of the strap, and the resultant free end portion is pressed against the inner face of the loop so that the Velcro® strip 29 is pressed against the opposing Velcro® strip 30 to secure the free end of the strap to the inside of the loop.

This forms a compact, comfortable and secure fastener of attractive appearance which can be adjusted quickly and easily as needed. The tension on the loop and the radial pressure of the wearer's head against the overlapping Velcro® strips will tend to make the connection even more secure, rather than tending to loosen the fastener as is the case with equivalent buckles where the free strap end is on the outside of the loop. Also, there are no free strap ends on the outside which would otherwise tend to give a more untidy appearance to the adjustable fastener. Since the loops are of fabric or like non-rigid material, there will be no uncomfortable metal buckle parts pressing against the wearer's head, and the loops can be made of any desired fabric color to match or coordinate with the remainder of the cap and the strap 24 and strap loop 28.

Figure 3:
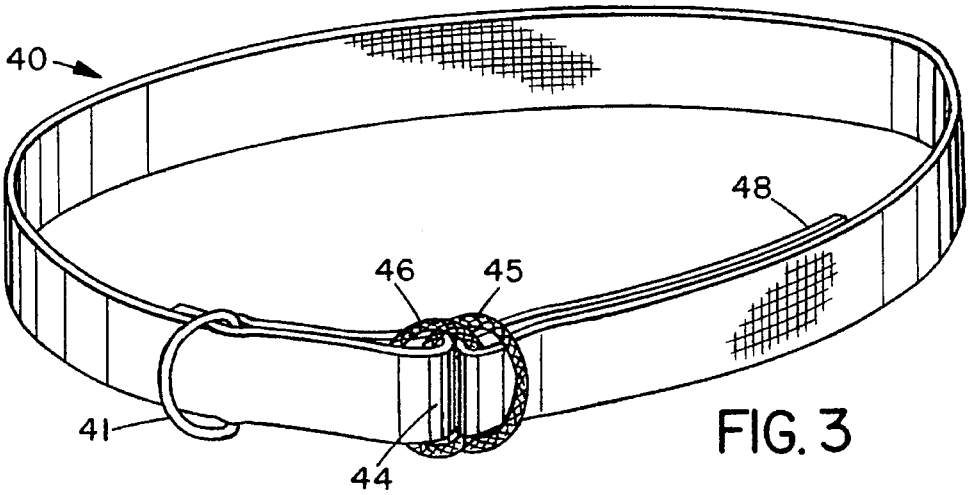
FIG. 3 is a perspective view of a belt or collar incorporating the fastener assembly.

Although the adjustable fastener assembly is described above in connection with adjustment of the size of a cap or hat, it may be used with any item of clothing or the like which is intended to encircle a portion of a wearer's body, in order to provide size adjustment. FIG. 3 illustrates an alternative embodiment of the invention in which the adjustable fastener assembly forms an integral part of a belt or collar 40 for adjustable engagement around the waist of a wearer or the neck of an animal, respectively, rather than part of a hat or cap. In this embodiment, an elongate strap or belt 40 has a loop 44 at one end in which a pair of overlapping inner and outer rings 45,46 are secured to form a buckle, and an opposite free end 48 for threading through the rings 45,46 to form a continuous loop, in an equivalent manner to fastener assembly 12 of the previous embodiment.

As in the previous embodiment, a first strip 50 of hook and loop fastener material is provided on the inner face of the strap adjacent the free end 48, and an opposing strip 52 of mating hook and loop fastener material is provided on the inner face of the loop formed by the belt or strap at a location adjacent the fastener assembly. The rings 45,46 are also of non-rigid, non-extensible material such as fabric or rope as in the previous embodiment. In the case of an animal collar, an additional ring 41 will be secured to the strap adjacent the fastener assembly for holding identification tags, license tags and the like, and for attachment of a lead as necessary, as indicated in dotted outline in FIG. 3.

Figure 4:
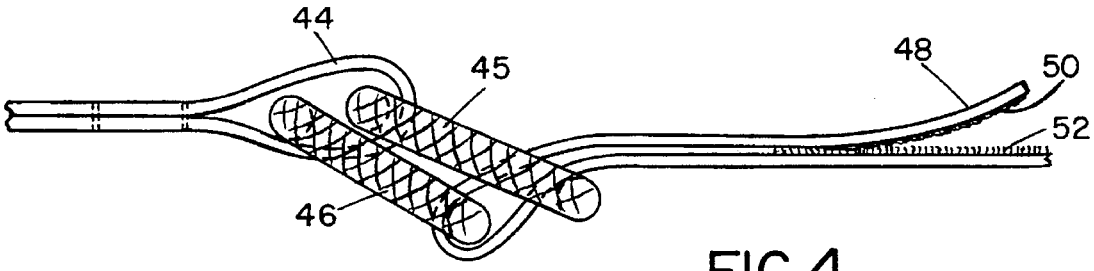
FIG. 4 is an enlarged top plan view of the fastener loosely engaged.

In order to secure the belt or collar around a waist or neck, after looping the belt around the desired region, the free end 48 of the belt is threaded through the center of ring 45, then around the outside of ring 46 and back through the centers of rings 46 and 45, as best illustrated in FIG. 4. The free end 48 is then located on the inside of the loop formed by the belt. The free end 48 is pulled through until the desired tightness is achieved, the buckle is tightened, and free end 48 is then pressed against the underlying inner face of the loop as illustrated in FIG. 4, so that the mating Velcro® strips 50 and 52 are engaged.

This arrangement avoids the inconvenience of a free strap end lying on the outside of a belt or collar, and also provides a secondary fastener between the opposite ends of the belt for added security. The arrangement is such that radial force on the inside of the belt will tend to tighten, rather than loosen, the buckle and Velcro® attachments. The fabric or rope buckle rings will be more comfortable than the conventional metal buckles generally used on belts and collars, and will have a more attractive appearance.

Although some preferred embodiments of the invention have been described above by way of example only, it will be understood by those skilled in the field that modifications may be made to the disclosed embodiments without departing from the scope of the invention, which is defined by the appended claims.

I claim:

1. An adjustable strap fastener assembly for securing in a loop around a portion of a wearer's body, comprising:

an elongate member for encircling a wearer's body, the elongate member having an inner face, an outer face, and opposite first and second ends;

a pair of overlapping rings secured to the first end of the elongate member;

the second end comprising a strap for releasable threaded engagement through the rings;

the elongate member having a first interengageable fastener device on said inner face at said second end and a second interengageable fastener device for releasable engagement with the first interengageable fastener device, the second interengageable fastener device being located on said inner face at a location spaced from said second end, whereby the second end of the strap is threaded through said rings and folded back to form a loop with said inner face facing inwardly and said first interengageable fastener device overlying and secured to said second interengageable fastener device to form a secondary connection for securing the elongate member in a loop with said outer face facing outwardly from the loop.

2. The assembly as claimed in claim 1, wherein the elongate member comprises a hat band.

3. The assembly as claimed in claim 1, wherein the elongate member comprises a peripheral rim of a hat.

4. The assembly as claimed in claim 1, wherein the elongate member comprises a belt for encircling a wearer's waist.

5. The assembly as claimed in claim 1, wherein the elongate member comprises a collar for encircling the neck of an animal.

6. The assembly as claimed in claim 1, wherein the rings are of non-rigid material.

7. The assembly as claimed in claim 1, wherein one of the interengageable fastener devices comprises a first strip of hook type fastener material and the other interengageable fastener device comprises a second strip of loop type fastener material mateable with said hook type fastener material.

8. A hat comprising:

a crown portion for covering the crown of a person's head, the crown portion having a front for location at the front of a person's head, a rear for location at the rear of a wearer's head, a concave inner face for facing a person's head when the hat is worn, and a convex outer face for facing outwardly from a person's head;

the crown portion having a cut-out opening at the rear of the hat, the cut-out opening having opposite side edges;

a pair of overlapping rings secured to one side edge of the opening;

a fastener strap having a first end secured to the opposite side of said opening and a second, free end for threading through said rings with the free end located inside said crown portion, the strap having an inner face and an outer face;

a first interengageable fastener portion on the inner face of said crown portion adjacent said opposite side of said opening and a second interengageable fastener portion on the inner face of said strap adjacent said free end for releasable mating engagement with said first fastener portion at the inner face of said hat.

9. The hat as claimed in claim 8, wherein the rings are of flexible, non-extensible material.

10. An adjustable strap fastener assembly for forming a loop of adjustable diameter, comprising:

an elongate member having an inner face, and outer face, and first and second ends, the inner face being adapted to face inwardly when the member is formed into a loop;

the first end being folded back and secured to the inner face of the elongate member to form an eyelet;

a pair of overlapping rings secured in said eyelet;

a first interengageable fastener device secured to the inner face of the elongate member at the second end; and a second interengageable fastener device secured to the inner face of the strap member at a location spaced from the second end for releasable engagement with the first fastener device when said second end is folded back over said inner face to form a second, releasable eyelet extending through said overlapping rings to form said elongate member into a loop with both ends of the elongate member on the inside of the loop.

11. The assembly as claimed in claim 10, wherein the rings are of non-rigid material.

12. The assembly as claimed in claim 11, wherein the rings are of flexible, non-extensible material.

13. The assembly as claimed in claim 12, wherein the rings are of rope material.

14. The assembly as claimed in claim 12, wherein the rings are of fabric material.

15. The assembly as claimed in claim 10, wherein the first interengageable fastener device comprises a first strip of hook-type fastener material and the second interengageable fastener device comprises a second strip of loop-type fastener material mateable with said hook-type fastener material.

16. A method of securing an elongate member around a portion of a wearer's body, comprising the steps of:

extending an elongate member around a portion of a wearer's body to form a loopshaving an inside and an outside, with an inner face of the member facing inwardly into the inside of the loop and an outer face of the member facing outwardly, the member having a pair of overlapping rings at one end and a second, free end, the rings comprising an innermost ring and an outermost ring;

threading the second end of the elongate member first through the center of the innermost ring in an outward direction away from the loop, then around the outside of the outermost ring and back through the center of the outermost ring and innermost ring to the inside of the loop;

pulling the second end through the rings until the loop has a selected diameter; and securing an interengageable fastener device on the inner face adjacent the second end to an underlying fastener device on the inner face of the elongate member within the loop.

17. A securing assembly, comprising:

an elongate member bent to form a loop, the elongate member having an inner face facing inwardly into the loop and an opposing, outer face, and opposite first and second ends;

a pair of overlapping rings secured to the first end of the elongate member;

a first interengageable portion secured to the inner face of the elongate member adjacent the second end and a second interengageable portion for releasable attachment to the first interengageable portion secured to the inner face at a location spaced from the second end; and the second end of the elongate member being threaded through the center of an innermost one of the rings, around the outside of the other ring and back through the center of both rings into the inside of the loop, and the first interengageable portion being secured to the second interengageable portion to secure the member in the loop.

* * * * *

UNITED STATES PATENT AND TRADEMARK OFFICE

CERTIFICATE OF CORRECTION

PATENT NO. : 5,600,854

DATED : February 11, 1997

INVENTOR(S) : SUSAN HENREKIN

It is certified that error appears in the above-indentified patent and that said Letters Patent is hereby corrected as shown below:

- COLUMN 6, CLAIM 16, LINE 14: DELETE "LOOPSHAVING" AND IN ITS PLACE INSERT --LOOP HAVING--.

Signed and Sealed this

Fifteenth Day of July, 1997

Bruce Lehman

*Attest:*

BRUCE LEHMAN

*Attesting Officer*

*Commissioner of Patents and Trademarks*